United States Patent [19]

Philip

[11] 4,394,928

[45] Jul. 26, 1983

[54] SPLASH-PROOF CONTAINER AND COVER

[76] Inventor: Morris Philip, c/o Philip Knitting Mills, 26 Bruckner Blvd., Bronx, N.Y. 10454

[21] Appl. No.: 246,043

[22] Filed: Mar. 20, 1981

Related U.S. Application Data

[63] Continuation-in-part of Ser. No. 138,444, Apr. 22, 1980, Pat. No. 4,322,014, which is a continuation-in-part of Ser. No. 61,197, Jul. 27, 1979, abandoned.

[51] Int. Cl.[3] ..... B65D 41/26; B65D 51/16

[52] U.S. Cl. ..... 220/366; 220/90.4; 220/367; 220/374; 222/547; 229/7 R; 229/43

[58] Field of Search ..... 220/366, 367, 90.2, 220/90.4, 374; 229/43, 7 R; 222/547, 564, 455, 478

[56] References Cited

U.S. PATENT DOCUMENTS

| | | | |
|---|---|---|---|
| 2,099,292 | 11/1937 | Brown | 222/478 |
| 2,456,989 | 12/1948 | Poleyn | 220/90.4 |
| 3,152,735 | 10/1964 | Caldwell | 222/547 |
| 3,727,808 | 4/1973 | Fitzgerald | 220/90.4 X |
| 3,895,743 | 7/1975 | Christian | 220/90.2 X |
| 3,915,355 | 10/1975 | Young | 220/90.2 X |
| 3,994,411 | 11/1976 | Elfelt et al. | 229/43 X |

*Primary Examiner*—Allan N. Shoap

*Attorney, Agent, or Firm*—Morgan, Finnegan, Pine, Foley & Lee

[57] ABSTRACT

A splash-proof container and container cover in which the container has a flange and shelf and the cover has flat areas and raised areas which in cooperation with the container shelf, passages in the cover connected to the cover raised areas and ports connected thereto permit fluid to flow from the container and air to enter the container when the container is tilted but which prevent liquid from splashing or spilling when the container is vertical and shaken or jostled.

6 Claims, 12 Drawing Figures

SPLASH-PROOF CONTAINER AND COVER

This application is a continuation-in-part of U.S. application Ser. No. 138,444, filed Apr. 22, 1980, now U.S. Pat. No. 4,322,014, issued Mar. 20, 1982, which, in turn, is a continuation-in-part of U.S. application Ser. No. 61,197, filed July 27, 1979, now abandoned and relates to splash-proof containers and covers for hot or cold liquids.

When liquids, such as, coffee, tea, and the like, are served on airplanes, trains, busses and moving vehicles, irregular movement of such vehicles often cause the liquid to jiggle and splash. Such jiggling and splashing can cause the liquid to spill out of the cup and container and over the hands and clothing of the person using such cup or container and over the clothing of other persons in the vicinity of the user. If the liquid is hot, such spilling can cause injury. In any event, spilling of the liquid on clothing can cause damage, stains and inconvenience.

Various attempts have, heretofore, been made to provide a cup or container and cover for preventing splashing and spilling of liquid for use on airplanes, trains, busses and moving vehicles. Such attempts, however, have resulted in cups, containers and covers which are expensive to produce, are difficult and cumbersome to use or interfere with liquid flow in such a way as to be undesirable for the user. Most commonly, to minimize splashing and spillage, such as in airplanes, it is usual practice to serve the liquid, such as coffee, in a partially filled container, for example, to only half or two-thirds fill the container. This, of course, requires refilling or additional containers, further service and is expensive and inconvenient. For the person drinking the liquid, it is a source of annoyance.

The difficulties encountered in attempts to provide a splash-proof container and cover are overcome in the forementioned applications by providing a container cover having fluid and air openings with a baffle or splash guard extending transverse of the openings on the liquid side of the cover and having a length longer than the length of the openings. The baffle or splash guard is sloped or curved downwardly from the center of the openings toward the liquid so that liquid which might flow thereon when the cup is shaken will flow downwardly and drain back into the container. Such cover of the applications or the container is provided with a spout of lip which is used in drinking from the container. The spout or lip is placed to the lips of the user and, as the container or cup is tipped in the conventional drinking manner the liquid flows through the openings between the ends of the baffle and bottom cover surface, over the baffle and through the container cover opening onto the spout and to the lips of the user. At the same time air flows through the air opening in the cover to prevent vacuum in the container and provide smooth and even flow of the liquid. If, as in drinking from a conventional cup, the liquid is too hot to drink, the container may be tipped back toward its vertical position and the liquid will flow back into the container through the liquid opening in the cover. If the liquid is not too hot, the container may be held tipped and the contents may be consumed by the user. The container might also be tipped so that the hot liquid will flow in a thin stream across the spout so as to cool the liquid before it is consumed.

While the cover and container of the aforementioned applications provide a container which is splash-proof, is easy to use and substantially eliminates most, if not all, of the difficulties in drinking from earlier containers, such cover and container is difficult and relatively expensive to produce. In such cover, the liquid and air openings are in one member and the baffles are made up in another member. This increases the difficulty and expensive of manufacture. A spout is required which must be added to the cover or container. When provided on the container, the cover must be applied to the container in a particular manner so as to align the fluid opening with the spout. The spout, whether applied to the cover or the container, requires care and precautions in stacking.

In the instant invention, the advantages of the splash-proof cover and container of the aforementioned applications are retained and many of the problems are overcome. This is accomplished in the instant invention with a one piece cover and with a container formed at its normally open end to accommodate the cover and, in combination with the cover, provide the necessary openings for liquid and for air passage. Both the container and the cover may be readily stacked and the cover may be applied to the container without need for alignment. The rim extending around the container and above the cover when the cover is in place serves as a spout and no separate spout is required.

The invention of the instant application will be more fully understood from the following description taken with the appended drawings of preferred embodiments in which FIG. 1 is a side view, partly broken away, of a cover and container of the invention and showing the container in drinking position;

Figure 1:
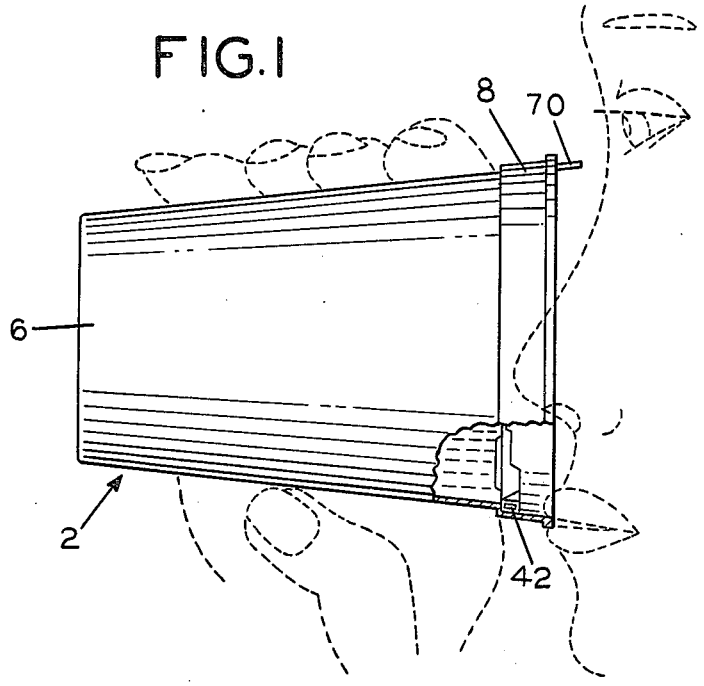

Referring to the drawings, particularly FIGS. 1–6, the splash-proof container and cover of the instant invention includes a container, generally designated 2, and a cover, generally designated 4.

Container 2 can be of plastic, glass, ceramic, coated paper board or any other material suitable for holding and dispensing a liquid, such as, hot coffee, hot tea, milk or the like, or a beverage. Preferably, container 2 is of a molded plastic, such as molded and compressed polystyrene and includes a tapered body portion 6 closed at its bottom end and opening into a tapered, open ended flange portion 8. The upper end of body 6 and lower end of flange 8 are joined and interconnected by shelf or ledge 11 which extends outwardly, substantially perpendicular to the vertical axis of container 2, and circumferentially around the container and forms, with the cover as will be hereinafter described, the spill-proof arrangement of the present invention. The width of shelf 11, as will be more apparent from the following description, is designed to cooperate with the cover and, with the cover, control the flow of liquid from the container. For most purposes, a radial shelf or ledge width of from about ⅛ in. to about 5/32 in. have been found to be acceptable. Because, preferably, the container and cover are molded, dimensions of container 2 and cover 4 may be held to rather close tolerances.

Figure 7:
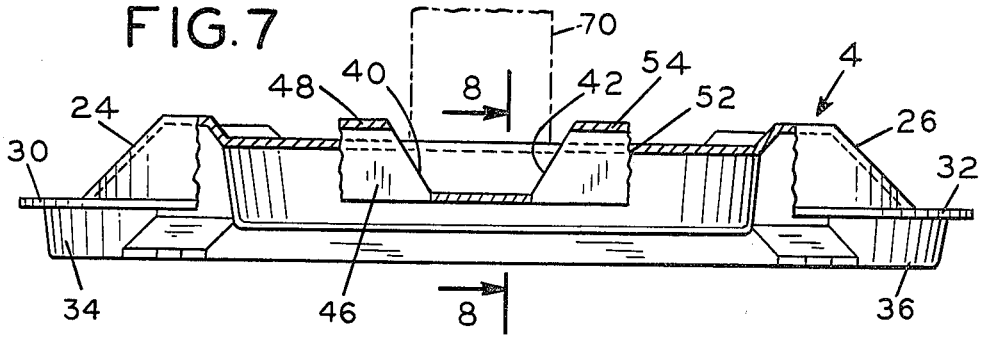
FIG. 7 is a sectional view taken at 7—7, FIG. 3.

As best shown in FIGS. 3, 4, 5 and 6, cover 4 is of one piece molded plastic and includes a depressed center portion 10 having transversely extending stiffening ribs 12, 14, 16 and arcuate stiffening rib 18 and radial ribs 20, 22 and 24, 26. The ribs are molded integrally into the cover and rib 22 and ribs 24, 26, in addition to stiffening and reinforcing the cover, which may be of relatively thin gauge plastic, also serve as air passages and liquid passages, respectively. Except at the pouring edge and the substantially opposite air bleed edge, marginal edges 30, 32 of cover 4 are substantially flat and engage and rest upon container shelf 11 when cover 4 is in place on container 2 forming a liquid tight closure with shelf 11. Inwardly of edges 30, 32, cover 4 extends downwardly at 34, 36, FIG. 7, to grip and engage the inner surface of container 2 just below shelf 11, when cover 4 is in place, forming a tight fit therewith and assisting in holding the cover on the container.

Figure 3:
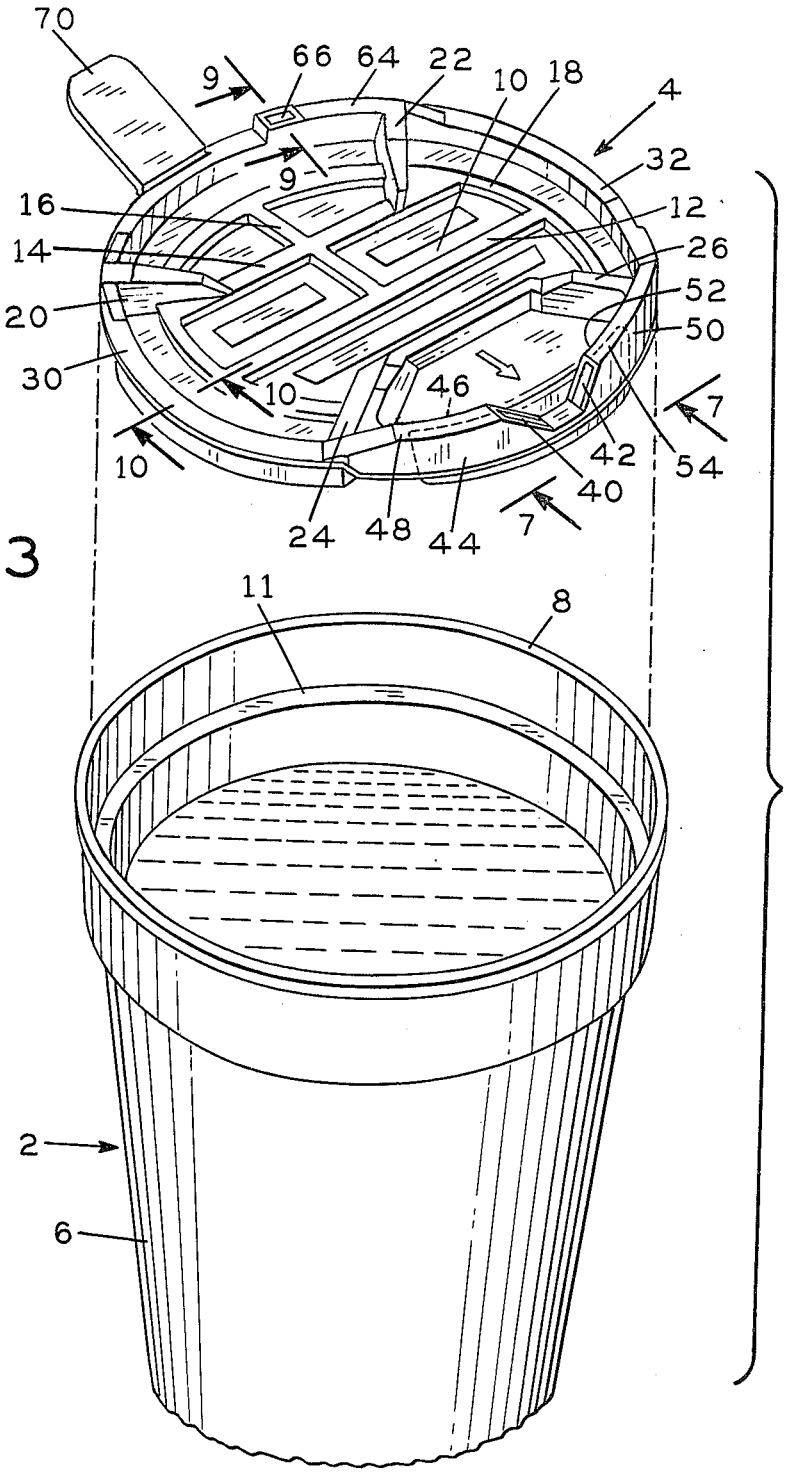
FIG. 3 is a perspective, expanded view of the cup and cover of FIG. 1 taken from the top of the cup.
Figure 4:
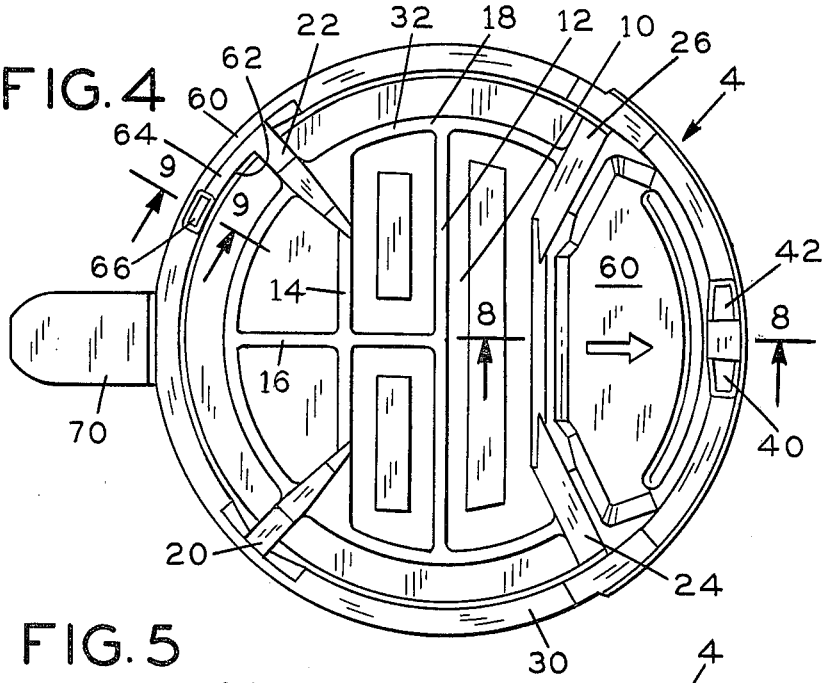
FIG. 4 is a top, plan view of the cover.
Figure 5:
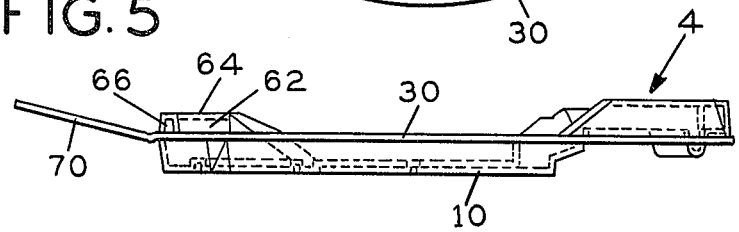
FIG. 5 is a side view of the cover of FIG. 4.
Figure 6:
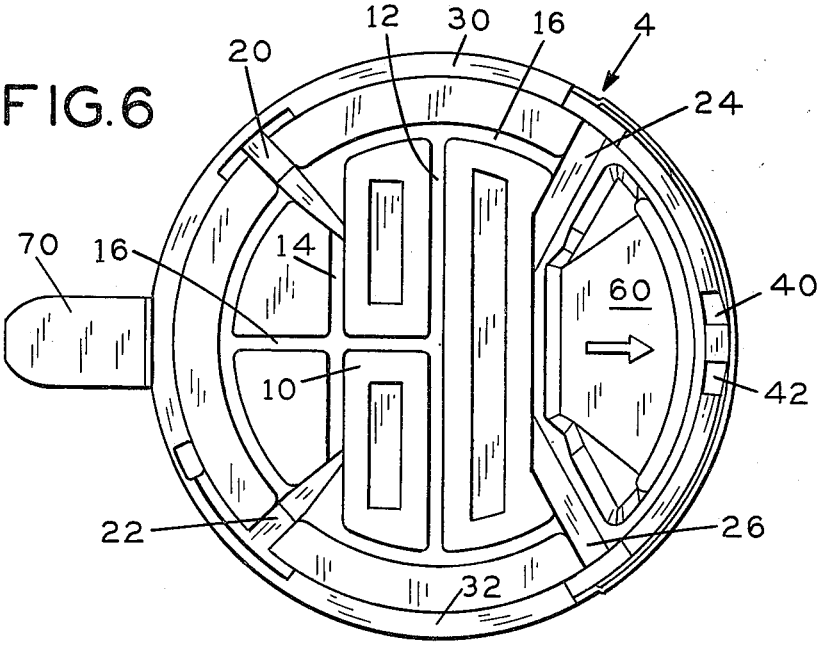
FIG. 6 is a bottom view of the cover of FIGS. 4 and 5.
Figure 8:
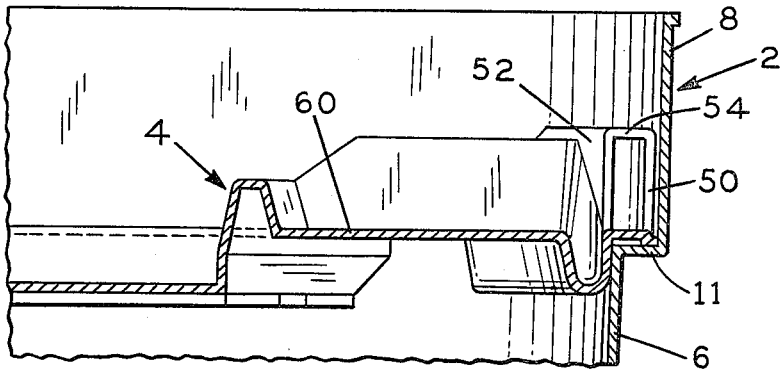
FIG. 8 is a sectional view taken at 8—8, FIGS. 4 and 7.
Figure 9:
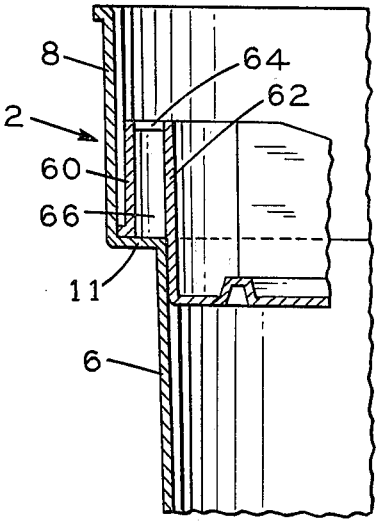
FIG. 9 is a sectional view taken at 9—9, FIG. 4.
Figure 10:
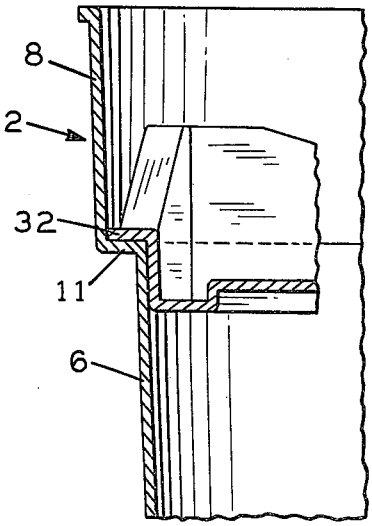
FIG. 10 is a sectional view taken at 10—10, FIG. 3.
Figure 12:
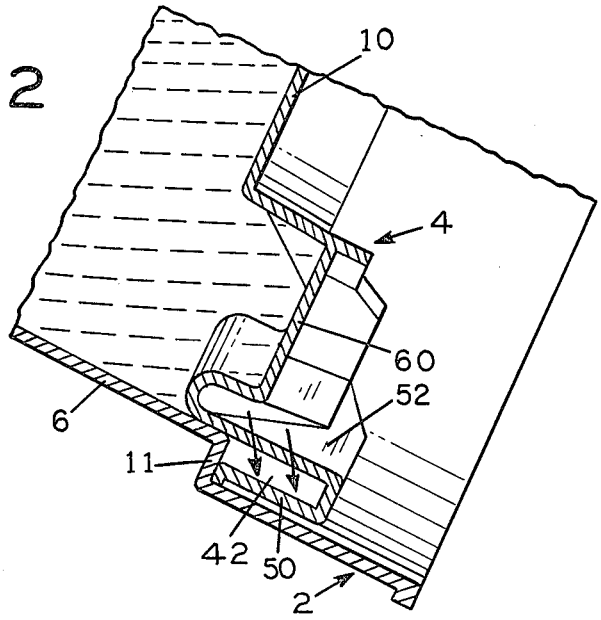
FIG. 12 is a sectional view taken at 12—12, FIG. 11.

With particular reference to FIG. 3, at the pouring edge and from pouring openings 40, 42 and extending arcuately along the edge of cover 4 from openings 40, 42 to liquid passage ribs 24, 26, the edge of cover 4 is raised, having a vertical outer wall 44, a vertical inner wall 46 and a connecting top wall 48 leading from liquid passage rib 24 to liquid opening 40 and a vertical outer wall 50, a vertical inner wall 52 and connecting wall 54 leading from liquid passage rib 26 to liquid opening 42. As best shown in FIGS. 8 and 12, inner walls 46, 52 extend downwardly below shelf 11 of container when cover 4 is in place, engage the inner surface of the container below the shelf, curve upwardly and merge into cover wall portion 60 which is raised relative to depressed center cover portion 10 between liquid passage ribs 24, 26. Vertical outer walls 44, 50 are spaced inwardly from the edge of cover 4 so as to provide a narrow clearance or passage between the walls and flange 8 when cover 4 is in place.

As best shown in FIGS. 3, 4, 5 and 9 the rim of cover 4 at the end of air bleed rib 22 is raised, having an outer wall 60, an inner wall 62, an upper connecting wall 64 and air port 66. Tab 70 is molded on cover 4 adjacent air port 66, is hinged to the cover and is used to remove the cover from container 2.

Containers 2 and covers 4 may be stacked, in conventional manner, with one container nested in another and packaged in a multi-container unit or tube. Covers 4 might be stacked, one on another and packaged in a multi-cover unit, tube, box or bag. When a container and cover are to be used, a container is removed from the package, filled with liquid, such as hot coffee and a cover is removed from the cover package and placed on top of the container over the liquid.

Figure 2:
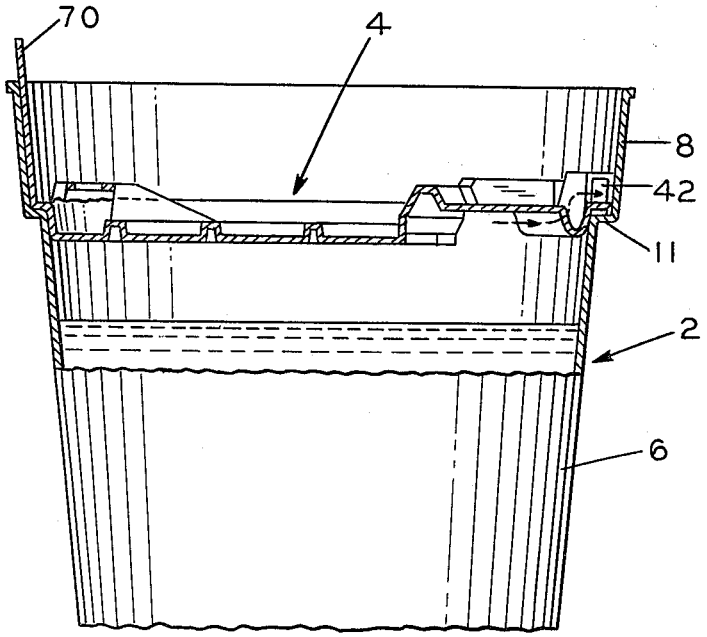
FIG. 2 is a side view, partly broken away, in section, showing the cup and cover of FIG. 1 in vertical upright position.

As best shown in FIGS. 2 and 3, container 2 may be filled with liquid to a level just below shelf 11 and cover 4 might then be applied. Cover 4 is pressed into flange 8 until edges 30, 32 and the lower edges of outer vertical walls 44, 50, 60 engage the surface of cup shelf 11. With cover 4 thus in place inner vertical walls 46, 52 at liquid openings 40, 42 and inner vertical wall 62 at air port 66 engage the inner wall of container 2 below shelf 11. Thus, except for passage through ribs 22, 24, 26 and the passage at substantial right angle thereto through the connected rim passages to liquid openings 40 or 42 or to air opening 66, the liquid is substantially trapped in the container. Hence, if the container is shaken or jostled while on a table or being held in a vertical position, as might occur in a car, on a plane or train, in a boat or while a person holding the covered container is walking or moving, the liquid in the container will not splash out and spill but, rather, will hit the cover and be retained in the container.

When it is desired to drink the liquid, such as hot coffee, from the covered container, the edge of the container flange intermediate liquid openings 40, 42 is placed to the drinker's lips and the container is tilted in the conventional drinking manner. The area of the container flange to be placed to the lips for drinking will, of course, depend upon the positioning of the cover on the container. For convenience for the drinker, such area may be designated with an arrow, as best shown in the drawings, formed in the cover during molding.

Figure 11:
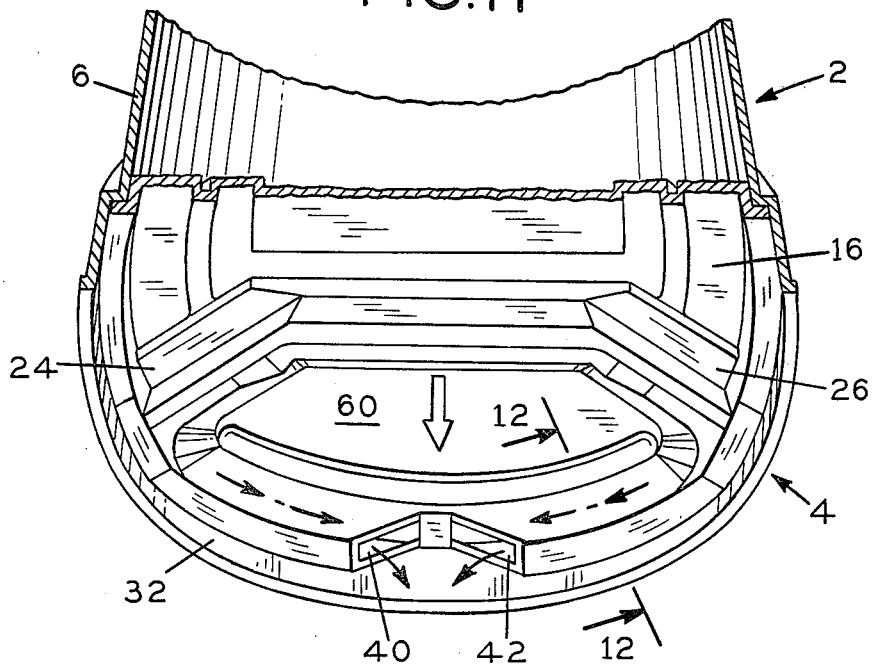
FIG. 11 is a perspective view, partly broken away, looking down from the top of the cup and cover.

When the container is placed to the lips and tilted, such as shown in FIG. 1, the liquid flows in the direction of the arrows, FIGS. 2, 11 and 12. Thus, the liquid flows outward through liquid passage ribs 24, 26 into and through the rim passages formed between walls 44, 46, 48 and walls 50, 52, 54 and shelf 11 to and through liquid openings 40, 42. As best shown in FIGS. 1 and 11, the liquid flows over the surface of flange 8 into the mouth of the drinker. The container may be tilted so that the liquid flow is slow, allowing the liquid to cool before it reaches the drinker's lips or the tilt of the container might be increased to increase the liquid flow and decrease cooling. In either event, as the liquid from the tilted container flows through liquid openings 40, 42 air is allowed to enter the container through air port 66. The air entering the container assures smooth liquid flow at openings 40, 42.

The container of the instant invention may be tilted and remain tilted until the liquid contents are consumed or, as is more commonly the case, the container might be repeatedly tilted and returned to vertical position until the contents are consumed. In either event, while the container is vertical, splashing and spilling of liquid from the container by shaking or jostling the container is substantially eliminated. At the same time, when it is desired to drink from the container, the container and cover need only to be properly aligned with the mouth of the drinker and tipped in the conventional manner. Removal of the cover from the container, which in the instance of hot coffee can be difficult, punching a hole in the cover or tearing the cover is not necessary. At the same time, when the container of the instant invention is returned to vertical positions, the integrity and splash-proof characteristics of the container and cover have not been altered or compromised. Any liquid remaining on the top of the cover, when the container is returned to its vertical position, can drain back into the container through the clearance between cover vertical walls 44 and 50 and container flange 8 and into the container through pouring openings 40, 42.

The terms and expressions which have been employed are used as terms of description and not of limitation, and there is no intention in the use of such terms and expressions, of excluding any equivalents of the features shown and described or portions thereof, but it is recognized that various modifications are possible within the scope of the invention claimed.

What is claimed:

1. A splash-proof container for liquids and a cover recessed within the open end of said container, said container having an upwardly extending flange defining the perimeter of its open end and extending upwardly above said cover and a shelf interconnecting said flange and the body of said container, said shelf extending substantially at right angle to the vertical axis of said container and transverse to said body and said flange and circumferentially around said vertical axis, said cover having a peripheral rim defining the outer perimeter thereof, said peripheral rim having flat portions thereof in engagement with said shelf, said peripheral rim having raised portions extending upwardly away from said shelf, said raised portions having spaced rib passages extending generally radially inwardly from said raised portions and said peripheral rim toward the center of said cover and opening into said container, liquid and air ports extending through said raised portions to the exterior of said container, said shelf, said raised portions in said peripheral rim, said generally radial rib passages and said ports forming connecting passages for liquid to flow from said container when said container is tilted and for air to flow thereinto but forming baffles and deflectors for the liquid contents of said container when said container is vertical and is shaken.

2. A splash-proof container and cover, as recited in claim 1, in which said liquid passages and ports and said air passages and ports are at substantially diametrically opposite edges of said cover.

3. A splash-proof container and cover, as recited in claim 2, in which said cover, in addition to said rib passages, has transversely and radially extending stiffening ribs.

4. A splash-proof container and cover, as recited in claim 1, in which said cover, in addition to said rib passages, has transversely and radially extending stiffening ribs.

5. A splash-proof container and cover for liquids, as recited in claims 3 or 4 in which said container and said cover are each of one piece molded plastic.

6. A splash-proof container and cover, as recited in claim 1, in which said cover is of one piece molded plastic.

* * * * *